US008723045B2

(12) United States Patent
Strahm, Jr.

(10) Patent No.: US 8,723,045 B2
(45) Date of Patent: May 13, 2014

(54) ASSEMBLY FOR SECURING A WIRE HARNESS TO A SENSOR COUPLER

(75) Inventor: Jack A. Strahm, Jr., Marysville, OH (US)

(73) Assignee: Honda Motor Co., Ltd., Tokyo (JP)

( * ) Notice: Subject to any disclaimer, the term of this patent is extended or adjusted under 35 U.S.C. 154(b) by 576 days.

(21) Appl. No.: 12/962,229

(22) Filed: Dec. 7, 2010

(65) Prior Publication Data

US 2012/0138333 A1 Jun. 7, 2012

(51) Int. Cl.

*H01B 7/00* (2006.01)
*H01B 7/40* (2006.01)
*H01R 13/56* (2006.01)

(52) U.S. Cl.

USPC ..... 174/135; 174/72 A; 439/446

(58) Field of Classification Search

USPC ..... 174/135, 72 A; 439/446
See application file for complete search history.

(56) References Cited

U.S. PATENT DOCUMENTS

| | | | | |
|---|---|---|---|---|
| 3,727,176 | A | 4/1973 | Oezer | |
| 3,732,527 | A * | 5/1973 | McKnight | 439/471 |
| 4,863,396 | A * | 9/1989 | Johnson | 439/470 |
| 4,902,150 | A * | 2/1990 | Imai et al. | 400/320 |
| 5,088,671 | A | 2/1992 | Chen | |
| 5,444,182 | A * | 8/1995 | Hoshino | 439/368 |
| 5,692,915 | A * | 12/1997 | Ishikawa et al. | 439/164 |
| 5,929,383 | A | 7/1999 | Marik et al. | |
| 5,962,814 | A * | 10/1999 | Skipworth et al. | 174/135 |
| 5,975,933 | A * | 11/1999 | Yamaguchi et al. | 439/247 |
| 6,435,902 | B1 | 8/2002 | Groh et al. | |
| 6,830,225 | B2 | 12/2004 | Kato | |
| 7,109,421 | B2 * | 9/2006 | Sekino et al. | 174/72 A |
| 7,165,980 | B2 * | 1/2007 | Pyron et al. | 439/100 |
| 7,284,785 | B2 * | 10/2007 | Gotou et al. | 296/155 |
| 7,369,381 | B2 * | 5/2008 | Tsukamoto et al. | 174/72 A |
| 7,645,938 | B2 * | 1/2010 | Kogure et al. | 174/72 A |
| 7,758,356 | B2 * | 7/2010 | Burris et al. | 439/95 |
| 8,025,525 | B2 * | 9/2011 | Krueger et al. | 439/446 |
| 8,313,340 | B2 * | 11/2012 | Krueger et al. | 439/446 |
| 2002/0129961 | A1 | 9/2002 | Baker | |
| 2007/0124923 | A1 | 6/2007 | Kogure | |
| 2007/0148994 | A1 * | 6/2007 | Sato et al. | 439/34 |
| 2008/0188120 | A1 * | 8/2008 | Tsuji | 439/470 |
| 2010/0307819 | A1 * | 12/2010 | Yamaguchi et al. | 174/70 R |

FOREIGN PATENT DOCUMENTS

| | | |
|---|---|---|
| CN | 201222637 | 6/2008 |

* cited by examiner

*Primary Examiner* — Jeremy C Norris
*Assistant Examiner* — Nathan Milakovich
(74) *Attorney, Agent, or Firm* — Rankin, Hill & Clark LLP

(57) ABSTRACT

A coupler for connecting a vehicle wire harness to a vehicle sensor comprises a body having a first end and a second end. The first end is operably connected to the vehicle sensor. The second end is adapted to connect with a first section of the vehicle wire harness. An assembly is associated with the body for attaching a second section of the vehicle wire harness, which is spaced from the first section of the wire harness, to the coupler. The assembly includes an attachment member which is rotatable at least partially about a longitudinal axis defined by the coupler body. The rotation of the attachment member relative to the coupler allows the second section of the vehicle wire harness to be properly positioned relative to the coupler and the vehicle sensor.

17 Claims, 4 Drawing Sheets

ASSEMBLY FOR SECURING A WIRE HARNESS TO A SENSOR COUPLER

BACKGROUND

Exemplary embodiments herein generally relate to a sensor coupler. More particularly, the present disclosure relates to an assembly associated with a sensor coupler for securing a vehicle wire harness to the sensor coupler, the assembly allowing the wire harness to be properly positioned relative to the installed sensor.

Generally, an electrical wire harness is secured to a sensor using a coupler which is operably connected to an end portion of the sensor. Some sensors are mounted in such a way that the final rotational position of the coupler after assembly is always the same. However, as depicted in FIGS. 1-3, the final orientation of a coupler 100 for a vehicle screw-in sensor 102 is difficult to ascertain. As shown, a threaded portion 104 of the screw-in sensor 102 is threadingly engaged in an opening 110 provided in a wall 112 of a first vehicle component or first structure 114. The first vehicle component 114 is located near a second vehicle component or second structure 118. A vehicle wire harness 120 is positioned between the first and second vehicle components 114, 118, and has an end portion 122 securely received in an end 124 of the coupler 100.

To prevent the wire harness 120 from contacting the second vehicle component 118, the wire harness 120 is typically fixedly secured to the coupler 100 via an attachment means, such as the illustrated strap 130. As depicted in FIG. 2, the strap 130 attaches a portion 132 of the wire harness 120 to an outside surface 134 of the coupler 100. With this strap 130, the wire harness 120 does not engage the second vehicle component 118. For the screw-in sensor 102, because the coupler 100 is fixed to the sensor 102, the coupler rotates with the sensor 102 as the sensor 102 is being threaded into the opening 110 provided in the first vehicle component 114. Thus, the orientation of the coupler 100 as the sensor 102 is being secured to the first vehicle component 114 is not controlled. This can cause the wire harness 120, which is typically secured to the coupler 100 prior to attachment of the sensor 102 to the first vehicle component 114, to rotate with the coupler. As such, the wire harness 120 becomes too tight. As a result, and as shown in FIG. 3, the portion 132 of the wire harness 120 attached to the coupler 100 is rotated away from the second vehicle component 118 and the wire harness 120 is stretched across the wall 112 of the first vehicle component 114. This stretching of the wire harness 120 can cause the end portion 122 to disengage from the coupler 100.

With reference to FIG. 4, one known solution to prevent this tightening of the wire harness 120 due to the rotation of the coupler 100 is to provide a separate bracket 140. The bracket 140 is mounted to the wall 112 of the first vehicle component 114 above the coupler 100 via a fastener 142. The wire harness 120 is then mounted to the bracket 140 via a conventional clip 144. However, this solution for controlling the position of the wire harness 120 relative to the coupler 100 as the screw-in sensor 102 is being attached to the first vehicle component 114 adds additional parts and cost to the vehicle.

BRIEF DESCRIPTION

In accordance with one aspect, a coupler for connecting a vehicle wire harness to a vehicle sensor comprises a body having a first end and a second end. The first end is operably connected to the vehicle sensor. The second end is adapted to connect with a first section of the vehicle wire harness. An assembly is associated with the body for attaching a second section of the vehicle wire harness, which is spaced from the first section of the wire harness, to the coupler. The assembly includes an attachment member which is rotatable at least partially about a longitudinal axis defined by the coupler body. The rotation of the attachment member relative to the coupler allows the second section of the vehicle wire harness to be properly positioned relative to the coupler and the vehicle sensor.

In accordance with another aspect, a vehicle assembly comprises a wire harness, a sensor in electrical communication with the wire harness, and a coupler connecting the wire harness to the sensor. The coupler includes a body, a clamp, and a track secured to the body. The clamp is attached to the body and the wire harness. The track has a channel for receiving an end portion of the clamp such that the clamp is moveable with respect to the body. Tension of the wire harness pulls the clamp along the track such that the wire harness is located in a desired position relative to the sensor.

In accordance with yet another aspect, a coupler for connecting an associated wire harness to an associated sensor comprises a body having a first end and a second end. The first end is operably connected to the associated sensor, and the second end is adapted to connect with a section of the associated wire harness. A track is located on the body and has a channel extending circumferentially around the body. A clamp has a retaining member configured to be attached to the associated wire harness. The clamp further includes an arm having an end section secured within the channel. The clamp selectively moves through the track channel such that the associated wire harness is located in a desired position relative to the associated sensor.

DETAILED DESCRIPTION

Figure 1:
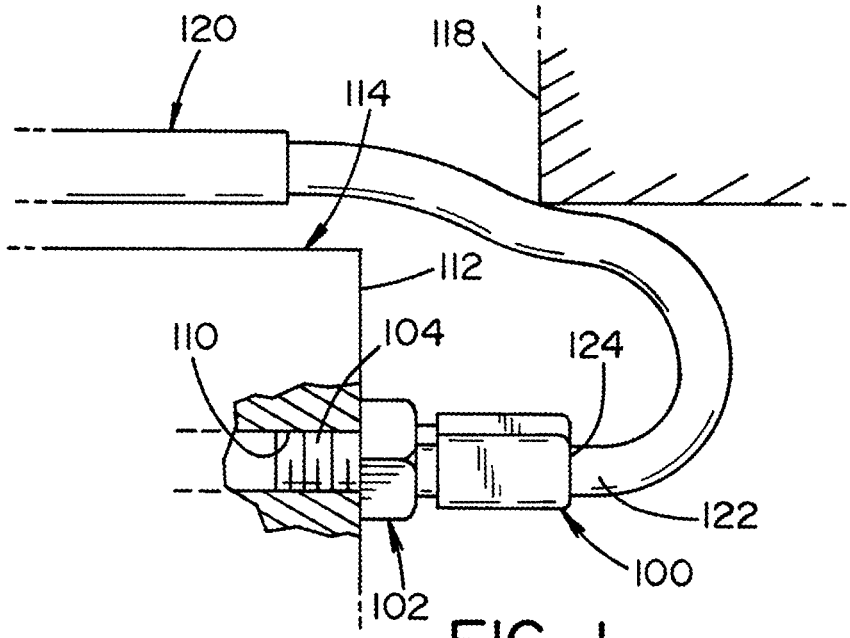
FIG. 1 (PRIOR ART)
FIG. 1 schematically illustrates a vehicle wire harness connected to a known coupler for a screw-in sensor. The wire harness is positioned between first and second vehicle components and is in contact with the second vehicle component.
Figure 2:
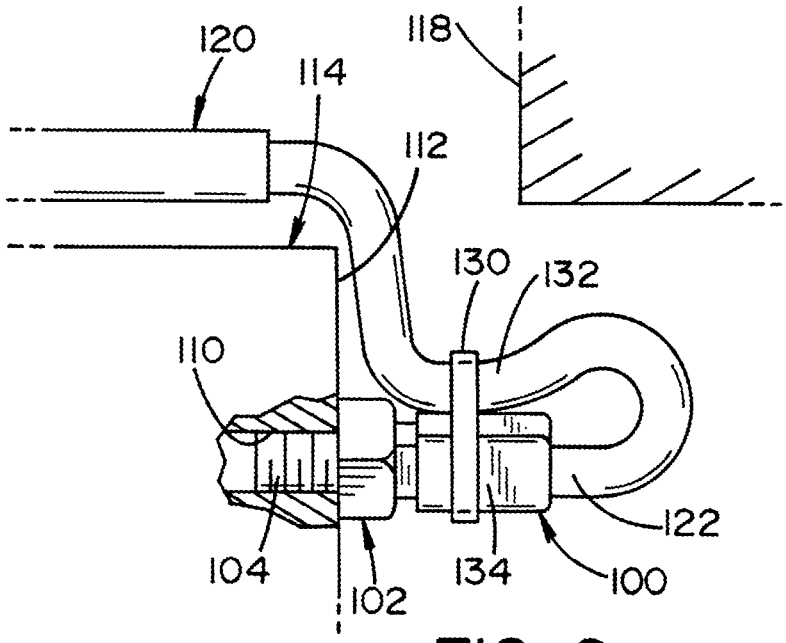
FIG. 2 (PRIOR ART)
FIG. 2 schematically illustrates the wire harness of FIG. 1 being secured to the known coupler via a conventional strap. The strap positions the wire harness away from the second vehicle component.
Figure 3:
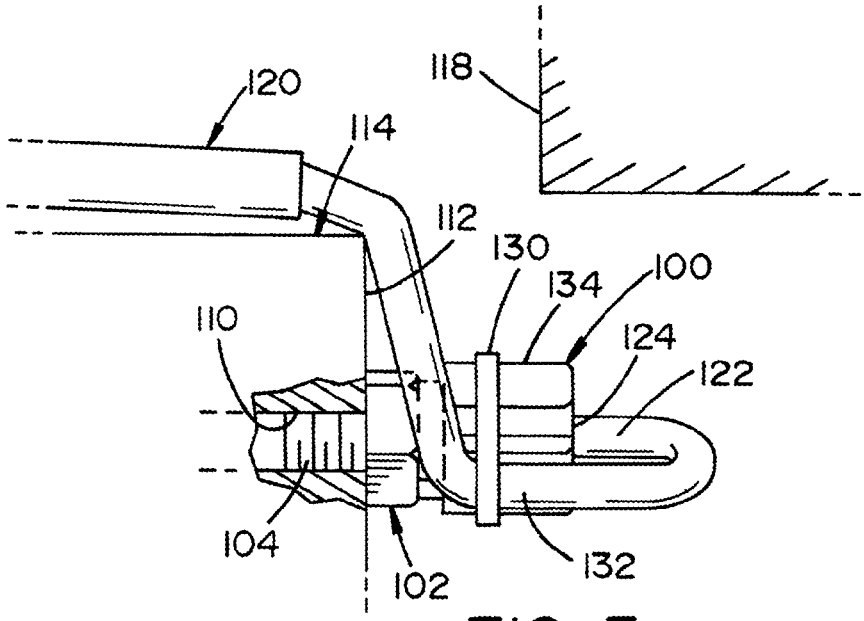
FIG. 3 (PRIOR ART)
FIG. 3 schematically illustrates the position of the wire harness of FIG. 1 after rotation of the known coupler due to the attachment of the screw-in to the first vehicle component. The rotation of the coupler the wire harness fixedly attached thereto to tighten and engage the first vehicle component.
Figure 4:
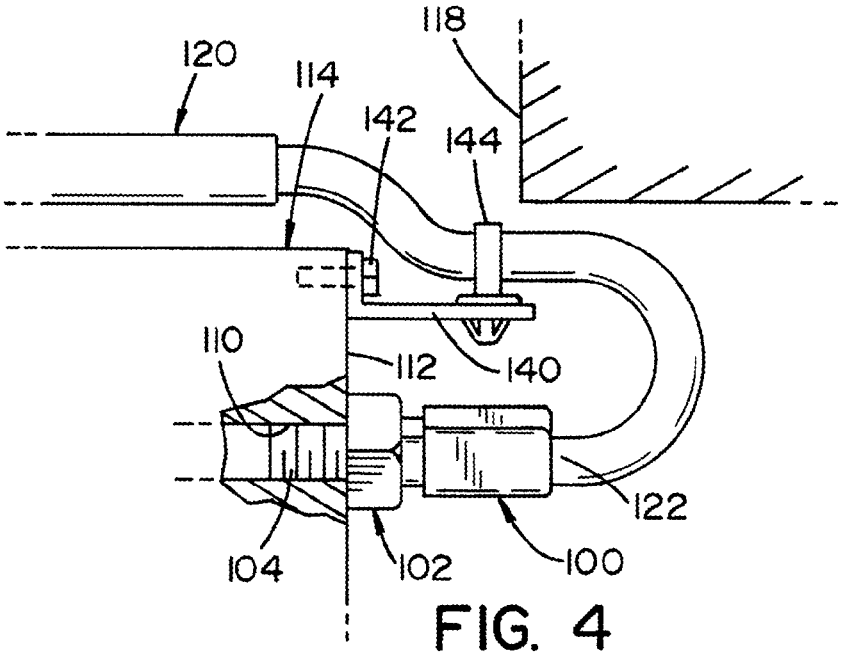
FIG. 4 (PRIOR ART)
FIG. 4 schematically illustrates the wire harness of FIG. 1 being secured to a bracket attached to the first vehicle component via a clip to prevent rotation of the wire harness with the coupler.

It should, of course, be understood that the description and drawings herein are merely illustrative and that various modifications and changes can be made in the structures disclosed without departing from the present disclosure. It will also be appreciated that the various identified components of the exemplary assembly for securing a vehicle wire harness to the exemplary sensor coupler disclosed herein are merely terms of art that may vary from one manufacturer to another and should not be deemed to limit the present disclosure.

Referring now to the drawings, wherein like numerals refer to like parts throughout the several views, FIGS. 5-8 illustrate an exemplary coupler 200 for connecting a vehicle wire harness 202 to a vehicle sensor 204 according to the present disclosure. The vehicle wire harness 202 is positioned between a first vehicle component or structure 210 and a second vehicle component or structure 212, which is spaced from the first vehicle component. An end portion 214 of the wire harness 202 is securely connected with the coupler 200 and is operably connected to the sensor 202. The end portion 214 of the wire harness is received in the coupler 200. As shown, the vehicle sensor 204 has a screw-in configuration and is connected to one of the first and second vehicle components 210,212. Particularly, the sensor 202 includes a threaded portion 230 which is threadingly engaged in an opening 232 provided in a wall 234 of the first vehicle component 210. It should be appreciated that the coupler 200 can be associated with vehicle sensors having alternative configurations.

The coupler 200 includes a body 240 having a first end portion 242 and a second end portion 244. The first end portion 242 is operably connected to the vehicle sensor 204. The second end portion 244 is adapted to receive the end portion 214 of the vehicle wire harness 202. To prevent the wire harness 202 from contacting the second vehicle component 212 after the sensor 204 is secured to the first vehicle component 210, an exemplary assembly 248 for securing the wire harness 202 to the sensor coupler 200 is provided. As will be discussed in greater detail below, the assembly 248 includes an attachment member 250 which attaches the vehicle wire harness 202 to the coupler body 240. The attachment member 250 is configured to rotate at least partially about a longitudinal axis LA defined by the coupler body 240. The rotation of the attachment member 250 relative to the coupler 200 allows the vehicle wire harness 202 to be properly positioned relative to the coupler and the vehicle sensor 204 and away from the first vehicle component 210 and/or the second vehicle component 212.

Figure 5:
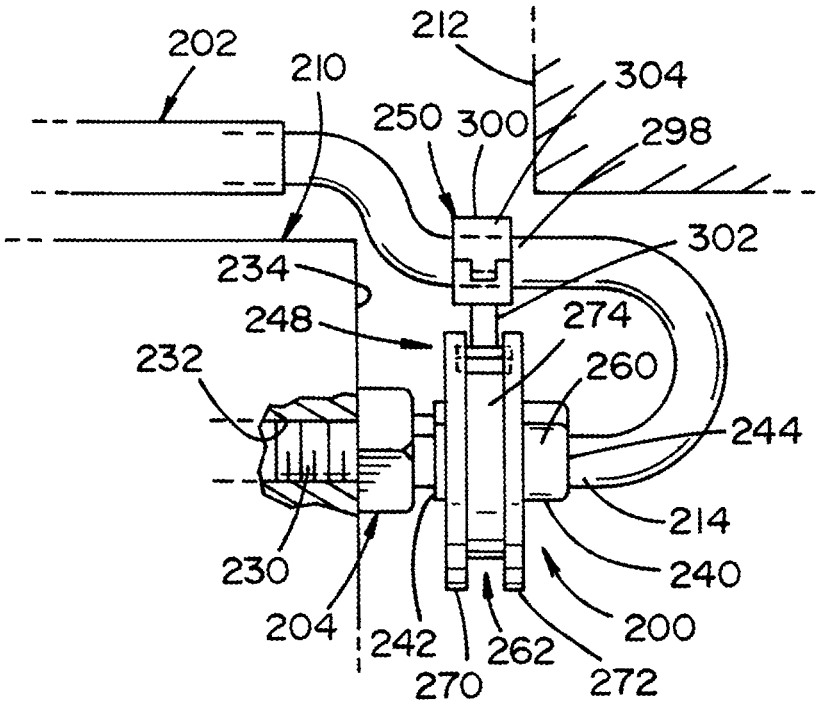
FIG. 5 schematically illustrates a vehicle wire harness being secured to an exemplary assembly associated with an exemplary sensor coupler for securing the wire harness to the sensor coupler according to the present disclosure.
Figure 6:
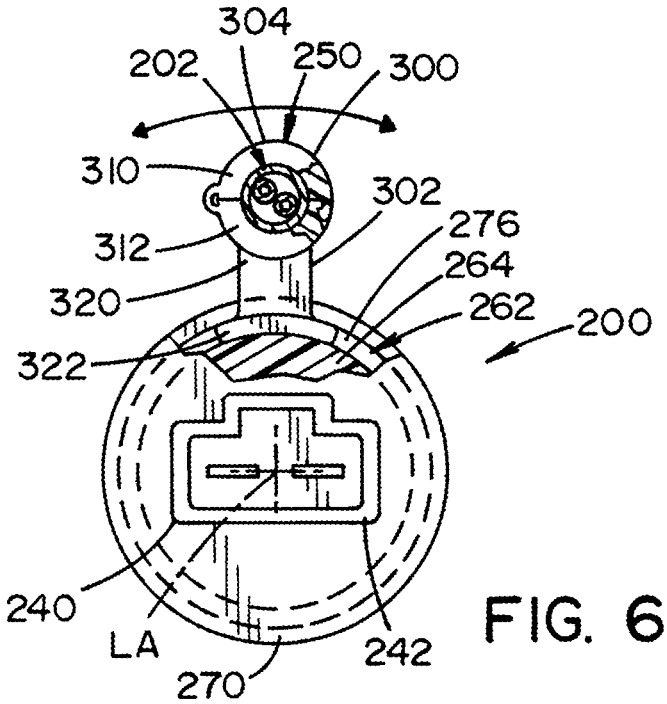
FIG. 6 is an end elevation view, partially broken away, of the exemplary assembly and sensor coupler of FIG. 5.
Figure 7:
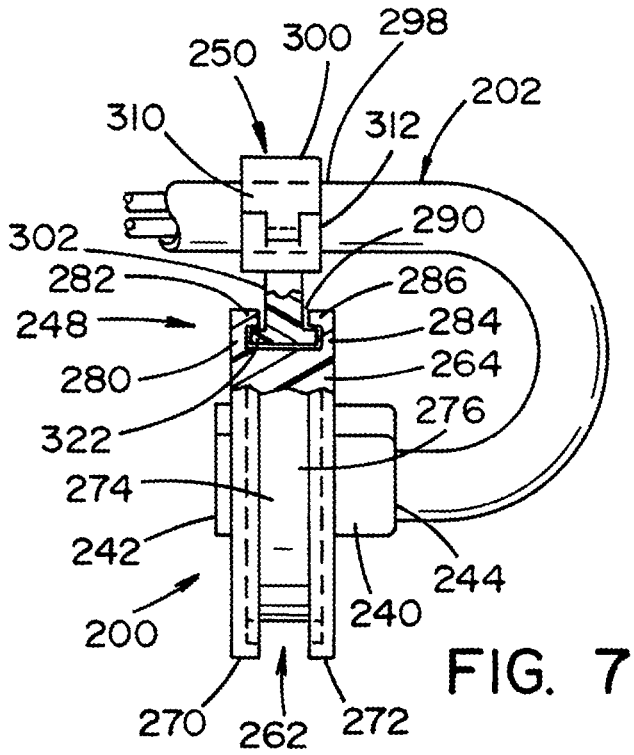
FIG. 7 is a side elevation view, partially broken away, of the exemplary assembly and sensor coupler of FIG. 5.
Figure 8:
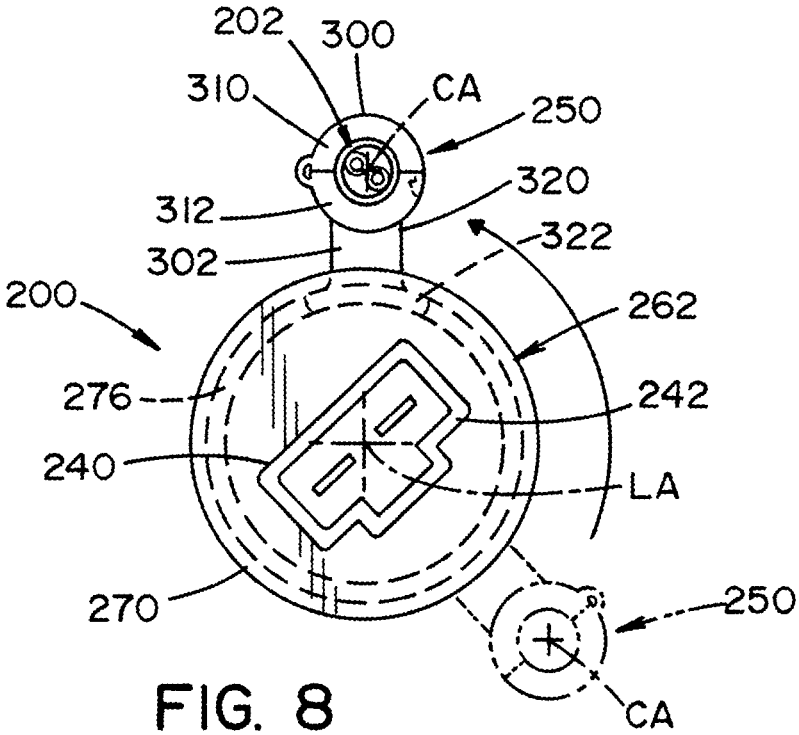
FIG. 8 schematically depicts rotation of the exemplary assembly of FIG. 5 about an axis defined by the exemplary sensor coupler, the rotation allowing the wire harness to be properly positioned relative to an installed sensor.

With continued reference to FIGS. 5-8, the coupler body 240 is configured to allow the attachment member 250 to freely rotate about an outer surface 260 of the coupler body. To that end, the assembly 248 further includes a track 262 on and/or mounted to the coupler body 240. The track 262 is shaped to allow rotation of the attachment member 250 regardless of the shape of the coupler body 240. For example, as depicted in FIGS. 6 and 8, the coupler body 240 has a rectangular cross-sectional shape and the track 262 has a circular cross-sectional shape (the cross-section of both the coupler body 240 and the track 262 being taken along a plane which is perpendicular to the longitudinal axis LA defined by the coupler body 240). According to one exemplary aspect, the track 262 includes a track body 264 which can be integrally formed with the coupler body; although, this is not required. As shown, the track 262 is located adjacent the first end portion 242 of the coupler. However, it should be appreciated that the track can be positioned adjacent the second end portion 244 of the coupler. The track 262 extends substantially around the outer surface 260 of the coupler body 240 such that the attachment member 250 can be selectively rotationally positioned about the coupler 200 As best illustrated in FIGS. 6 and 8, the exemplary track 262 extends circumferentially or completely around the outer surface of the coupler body. This allows the wire harness 202 to be properly positioned relative to the sensor 204 and away from the first vehicle component 210 and/or the second vehicle component 212.

The track 262 further includes a first wall 270, a second wall 272 which is axially spaced from the first wall 270, and a base wall 274 which spans between the first and second walls 270,272. Each of the first and second walls 270,272 is generally circular shaped; although, alternative shapes for the first and second walls are contemplated. The first and second walls 270,272 together with the base wall 274 define a channel 276. The channel 276 is configured to receive a portion of the attachment member 250, and a portion of the track 262 extends at least partially into the channel 276 for retaining the portion of the attachment member 250 therein. More particularly, and as best depicted in FIG. 7, the first wall 270 includes a first section 280 and a second section 282. The first section 280 extends generally perpendicularly from the base wall 274, and the second section 282 extends generally perpendicularly from the first section 280 toward the second wall 272. Similarly, the second wall 272 includes a first section 284 and a second section 286. The first section 284 extends generally perpendicularly from the base wall 274, and the second section 286 extends generally perpendicularly from the first section 284 toward the first wall 270. This configuration of each of the first and second walls 270,272 provides for an opening 290 of the channel 276 having a reduced dimension compared to the spacing between the first and second walls (i.e., the dimension of the channel along the longitudinal axis of the coupler body 240). This reduced opening 290 retains the portion of the attachment member 250 within the channel 276 as the attachment member rotates about the coupler body 240.

With reference again to FIGS. 5-8, the attachment member 250 includes a retaining member or clamp 300 having an end portion or arm 302 extending from the clamp. The arm 302 is movably received in the channel 276 so that the clamp is selectively movable relative to the coupler body 240 such that a second section 298 of the wire harness 202 is located in a desired position relative to the sensor 204. The clamp 300 is configured to securely attach to the second section 298 of the wire harness 202. The second section 298 is offset from the first section or end portion 214 of the wire harness 202 along the length of the wire harness. As illustrated in FIG. 5, the clamp 300 is offset from each of the first and second vehicle components 210,212 in a direction parallel to the longitudinal axis LA of the coupler body 240. As such, once secured within the clamp 300, the second section 298 is also offset from the first and second vehicle components 210,212.

In the depicted exemplary embodiment, the clamp 300 includes a clamp body 304 having a longitudinal axis CA which is spaced from and parallel to the longitudinal axis of the coupler body 240. The clamp body 304 has a first section 310 and a second section 312. The first and second sections 310,312 are hingedly connected at one respective end and are releasably connected at the other respective end. This allows the wire harness 202 to be easily positioned in the clamp 300. As shown, an inner surface of both the first and second sections 310,312 are shaped to at least partially compress the wire harness 202 when the clamp is in a closed position; although, this is not required. The second section 312 is secured to an upper end portion 320 of the arm 302. A lower end portion 322 of the arm 302 is configured to be received in the track channel 276 and move through the track channel 276. Particularly, the lower end portion 322 has a cross-sectional shape substantially mirroring a cross-sectional shape of the track channel 276 (the cross-section of both the arm end portion 322 and the track channel 276 being taken along a plane extending along the longitudinal axis LA defined by the coupler body 240). This also prevents the lower end portion 322 of the arm 302 from falling out of the track 262 as the attachment member 250 rotates about the coupler body 240 due to the tension of the wire harness 202 pulling the clamp 300 through the track. As indicated previously, the rotation of the wire harness 202 relative to the coupler 200 allows the wire harness to be located in a desired position relative to the sensor 204 and the first and second vehicle components 210,212.

As is evident from the foregoing, according to the present disclosure, the exemplary coupler 200 is provided with the attachment member 250 which can be secured to the wire harness 202 and which can move relative to the coupler. The coupler 200 includes the circumferential track 262 having the channel 276 and the attachment member 300 includes the arm 302 having an end portion 322 secured within the track for movement relative to the track. The other end portion 320 of the arm 302 is connected to the retaining member or clamp 300 having an opening for securely receiving therein the wire harness 202. The arm 302 snaps into the circumferential track 262 of the coupler 200 and once in the track, the clamp 300 can rotate about the coupler, which provides a positive location for the wire harness 202. As such, no matter how the coupler 200 is oriented and where the wire harness clamp 300 is initially positioned, the wire harness tension will pull the clamp along or through the circumferential track 262 such that the wire harness 202 ends in a desired position. This allows the wire harness 202 to be clamped to the sensor coupler 200 and simultaneously allows the wire harness 202 to rotate about the coupler 200 by a full 360 degrees. The exemplary coupler 200 including the attachment member 250 is compact, allowing it to be used when packaging limitations prevent the addition of a separate bracket to secure the wire harness. The exemplary coupler 200 including the attachment member 250 also allows the wire harness 202 to be secured to the clamp 300 before delivery to the vehicle assembly plant. This saves process time as the factory does not need to bolt on additional parts.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A coupler for connecting a vehicle wire harness to a vehicle sensor comprising:

a body having a first end and a second end, the first end being operably connected to the vehicle sensor, the second end being adapted to connect with a first section of the vehicle wire harness; and an assembly associated with the body for attaching a second section of the vehicle wire harness, which is spaced from the first section of the wire harness, to the coupler, the assembly includes an attachment member connected to and extending perpendicularly from the coupler body, the attachment member rotatable at least partially about a longitudinal axis defined by the coupler body, the rotation of the attachment member relative to the coupler allowing the second section of the vehicle wire harness to be properly positioned relative to the coupler and the vehicle sensor, wherein the coupler body is configured to allow the attachment member to rotate about an outer surface of the coupler body, and further including a track mounted to the coupler body, the track defining a channel configured to receive the attachment member, the track extending substantially around the outer surface of the coupler body such that the attachment member can be selectively rotationally positioned about the coupler.

2. The coupler of claim 1, wherein the track is integrally formed with the coupler body.

3. The coupler of claim 1, wherein the track extends completely around the outer surface of the coupler body.

4. The coupler of claim 1, wherein a portion of the track extends at least partially into the channel for retaining the attachment member therein as the attachment member rotates about the coupler body due to tension of the wire harness pulling the attachment member through the track.

5. The coupler of claim 1, wherein the attachment member includes a clamp configured to securely attach to the second section of the wire harness and an arm extending from the clamp, the arm having an end portion received in the track channel for moving through the track channel.

6. The coupler of claim 5, wherein the end portion of the arm has a cross-sectional shape substantially mirroring a cross-sectional shape of the track channel, the cross-section of both the arm end portion and the track channel being taken along a plane extending along a longitudinal axis defined by the coupler body.

7. The coupler of claim 1, wherein the track is located adjacent the first end of the coupler body.

8. The coupler of claim 1, wherein the coupler body has a rectangular cross-sectional shape and the track has a circular cross-sectional shape, the cross-section of both the coupler body and the track being taken along a plane which is perpendicular to a longitudinal axis defined by the coupler body.

9. A vehicle assembly comprising:

a wire harness;

a sensor in electrical communication with the wire harness; and a coupler connecting the wire harness to the sensor, the coupler including:

a body defining a longitudinal axis;

a clamp attached to the body and the wire harness, the clamp defining a longitudinal axis which is spaced from and parallel to the longitudinal axis of the body; and a track secured to the body, the track having a channel for receiving an end portion of the clamp such that the clamp is moveable with respect to the body, wherein tension of the wire harness pulls the clamp along the track such that the wire harness is located in a desired position relative to the sensor.

10. The vehicle assembly of claim 9, wherein the channel extends circumferentially around the body.

11. The vehicle assembly of claim 10, wherein the clamp includes an arm having an end portion moveably secured within the track channel.

12. The vehicle assembly of claim 9, further including a first vehicle component and a second vehicle component spaced from the first vehicle component, wherein the sensor is a screw-in sensor threadingly secured to the first vehicle component.

13. The vehicle assembly of claim 12, wherein the wire harness is located between the first and second vehicle components, the clamp moving the wire harness away from engagement with the first and second vehicle components as the sensor is being secured to the first vehicle component.

14. A coupler for connecting an associated wire harness to an associated sensor comprising:

a body having a first end and a second end, the first end being operably connected to the associated sensor, the second end being adapted to connect with a section of the associated wire harness;

a track located on the body, the track having a channel extending circumferentially around the body; and a clamp having a retaining member configured to be attached to the associated wire harness, the clamp further including an arm having an end portion secured within the channel, wherein the clamp selectively moves through the track channel such that the associated wire harness is located in a desired position relative to the associated sensor.

15. The coupler of claim 14, wherein the track is located adjacent end portion of the coupler that is connected to the associated sensor.

16. The coupler of claim 14, wherein each of the body and the clamp defines a longitudinal axis, the clamp longitudinal axis being spaced from and parallel to the body longitudinal axis, the clamp being rotatable about the body longitudinal axis.

17. The coupler of claim 14, wherein an opening of the channel has a dimension smaller than a dimension of the channel which prevents the end portion of the arm from falling out of the channel as the clamp rotates about the coupler body due to tension of the associated wire harness pulling the clamp through the track.

* * * * *